United States Patent [19]

Büttner

[11] 4,356,685

[45] Nov. 2, 1982

[54] MACHINE FOR TYING PACKAGES OR THE LIKE

[76] Inventor: Hans H. Büttner, Obmettmann 13, 4020 Mettmann, Fed. Rep. of Germany

[21] Appl. No.: 46,597

[22] Filed: Jun. 7, 1979

[30] Foreign Application Priority Data

Jun. 9, 1978 [DE] Fed. Rep. of Germany ..... 2825332

[51] Int. Cl.[3] ..... B65B 13/24

[52] U.S. Cl. ..... 53/588; 53/582; 100/28

[58] Field of Search ..... 53/588, 587, 582, 589; 100/28, 27

[56] References Cited

U.S. PATENT DOCUMENTS

| | | | |
|---|---|---|---|
| 2,088,133 | 7/1937 | Evans | 100/28 |
| 2,124,770 | 7/1938 | Evans | 100/28 |
| 2,307,219 | 1/1943 | Harvey | 100/27 |
| 2,972,844 | 2/1961 | Ripley | 100/27 X |
| 3,232,216 | 2/1966 | Cranston | 100/28 |
| 3,324,789 | 6/1967 | Buettner | 100/27 |

*Primary Examiner*—John Sipos
*Attorney, Agent, or Firm*—Martin A. Farber

[57] ABSTRACT

Machine for tying packages or the like in which the tying means which is held fast at one end is guided by means of a tying means guide device around the package in the manner that the tying means guide device which is driven cyclically back and forth, its forward movement, accumulates a layer of tying means which surrounds the package, which layer is wound around the package upon the following return run, and in which there is preferably provided, below the support table for the package, a sealing device which connects the ends of the tying means and cuts off one end, the sealing device having grippers associated with it for holding the tying means fast. Each one of the grippers together with the end of the tying means held fast by it, carries out in cyclic dependency, a rotary movement which turns the gripper slot around. One of the two grippers, respectively, which are additionally axially displaceable, in a crosswise rotary position of its gripping slot S, pushes the tying means from the sealing device.

8 Claims, 14 Drawing Figures

MACHINE FOR TYING PACKAGES OR THE LIKE

Figure 1:
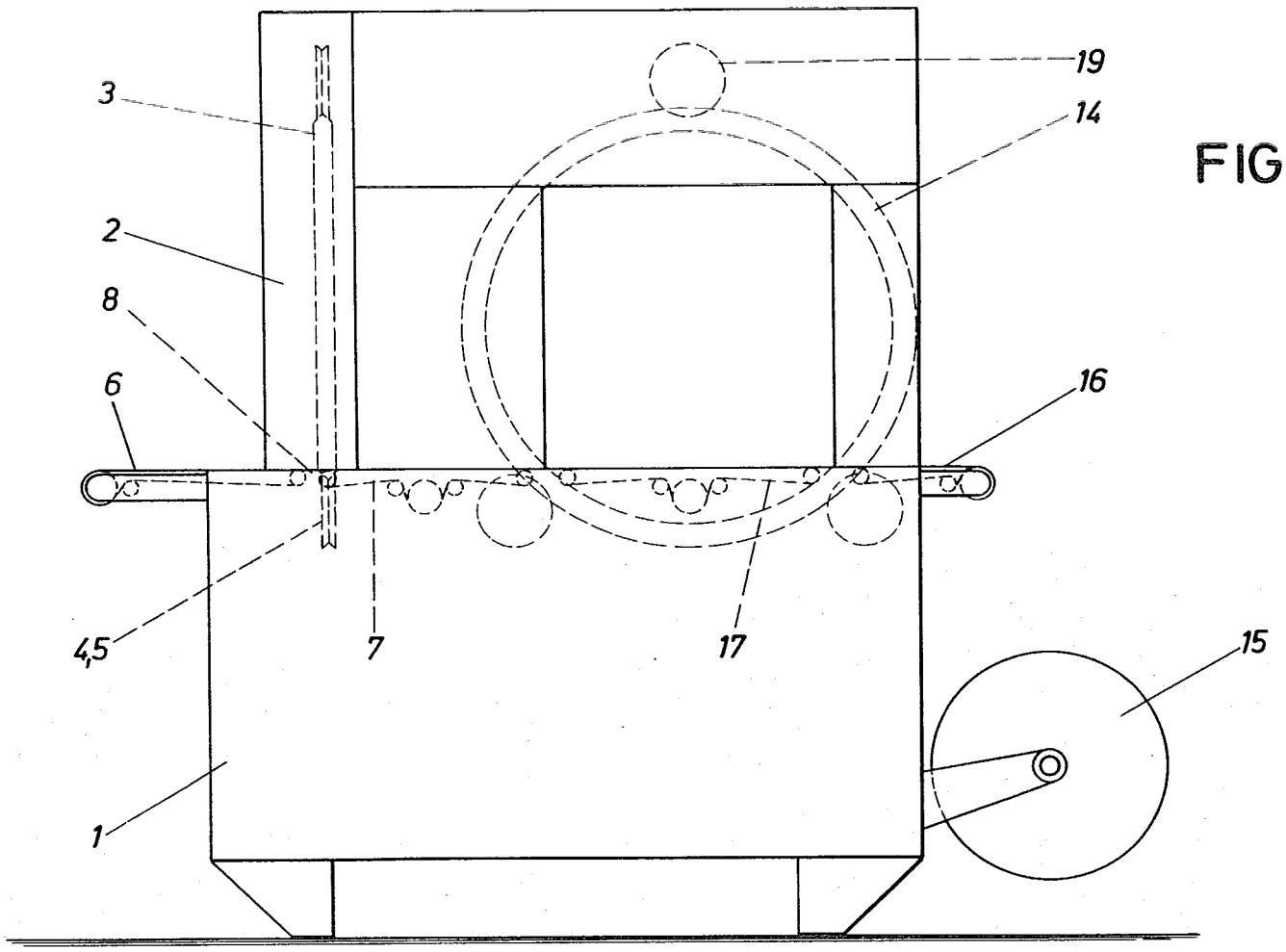

The invention relates to a machine for tying packages or the like in which the tying means which is held fast at one end is guided by a means of a tying means guide device around the package in the manner that the tying means guide device which is driven cyclically back and forth, upon its forward movement, accumulates a layer of tying means which surrounds the package, which layer winds around the package upon the following return run, and in which there is preferably provided, below the support table for the package, a sealing device which connects the ends of the tying means and cuts off one end, the sealing device having grippers associated with it for holding the tying means fast, each one of the grippers, together with the end of the tying means held fast by it, carrying out in cycle dependency, a rotary movement which turns the gripper slot around.

This development has the advantage that the tying means, when being placed around the package by the tying means guide device, need not be pulled over the corners of the package. The tying means guide device may be a closed ring.

The object of the invention is to simplify a machine of the aforementioned type having a simple manner of manufacture in such a way that a dependable transfer of the end of the tying means to the gripper of the sealing device and an undisturbed tying operation are still assured as well as the ejection of the tying means from the sealing device.

A machine of the above-mentioned type is provided whose sealing or closure device including the grippers, is extensively adapted to the manner of operation of the tying means guide device. The construction can be kept simple and, furthermore, the manner of operation is not subject to breakdown or trouble. At each time, respectively, one of the two grippers (which two grippers are controlled in cycle dependency or in synchronism) holds the end of the tying means in the starting position, while the gripper slot of the other gripper lies in the plane of the tying means and indeed in the ready position. Thus, after a single rotation of the tying means guide device, after a complete wrapping of the package, the corresponding section of the tying means can pass into the gripper slot, whereupon this gripper steps into the closed position. The tying means is held by both grippers and the binding or connecting process of the sealing device can commence. After the binding has been effected, the gripper holding the end of the tying means opens and, thereupon, both grippers carry out a rotary movement so that the gripper slot of the one gripper is now in the ready position. Upon the return travel of the tying means guide device, the tying means is then inserted into the slot. Therefore, there is present an alternate operation of the two grippers which are coordinated or synchronized to each other. The upper pressing jaw of the sealing device and the grippers themselves may be of small dimensions, which permits a tight tying of the package. Furthermore, the tying means is not wound around the gripper itself upon its return travel. Thus no formations of loops occur on the tying means. A multiple function of the grippers is achieved in accordance with the invention in the manner that respectively one of the two grippers (20, 27) which are additionally axially displaceable, in a crosswise rotary position of its gripper slot (S), pushes the tying means (9) out of the sealing device (22). Additional ejector parts can thus be dispensed with and are not necessary.

One advantageous further development resides in the fact that the one gripper jaw is formed as a ram which is axially displaceable in the other jaw, which ram has a beveled run-on surface for the end of the tying means. The gripper jaws are accordingly nested or inserted one within the other, which is very advantageous for a compact construction.

In this connection, it is advantageous for the counter jaw coordinated to the ram to be formed from the trough section of a ring sector, which sector projects at the end side.

Furthermore, one advantageous feature resides in the fact that the sector is provided on the end side of a rotatably mounted sleeve. The displacement of the sleeve can take place, for instance, in the manner that it forms a toothing which cooperates with a meshing or counter toothing.

Furthermore it is an advantage that the grippers which additionally are controlled or moved upwardly and downwardly alternately pull the tying means held by them over the cutting knife of the sealing device.

Finally, an advantageous feature also resides in the fact that the opening sides of both grippers point in opposite directions so that the opening side of one gripper slot points upwardly when that of the other gripper is directed downwardly.

Figure 2:
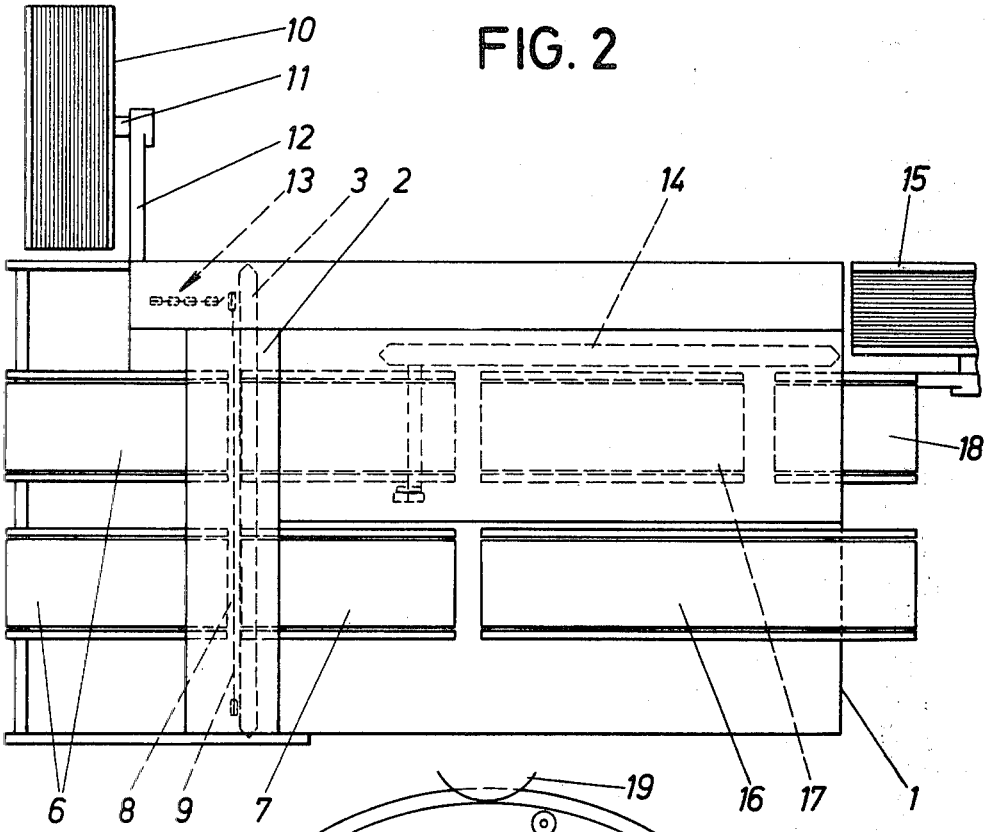
Figure 3:
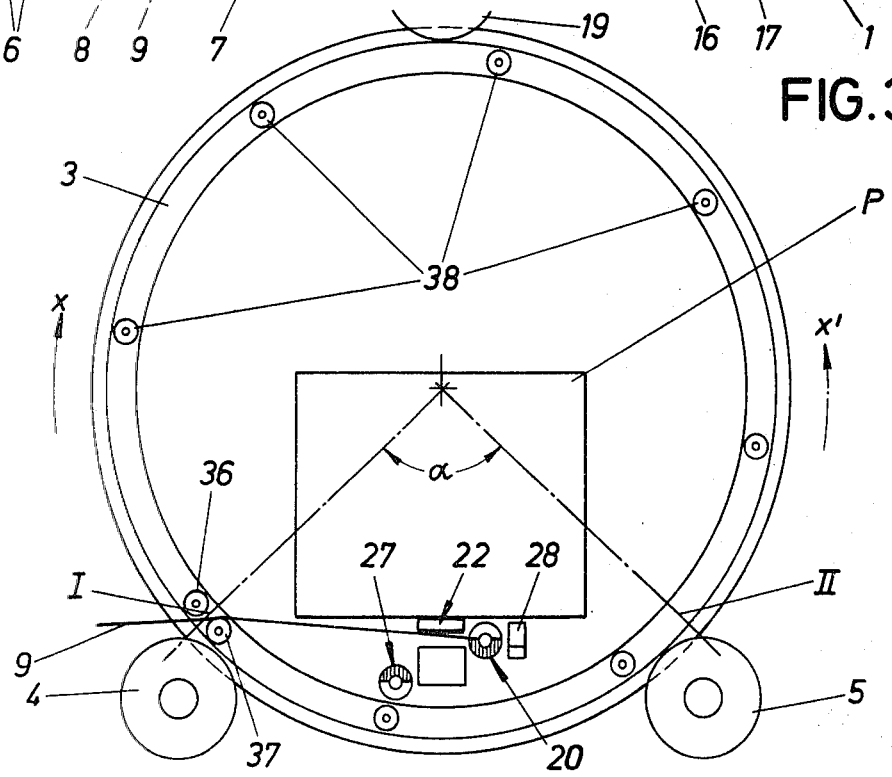
Figure 4:
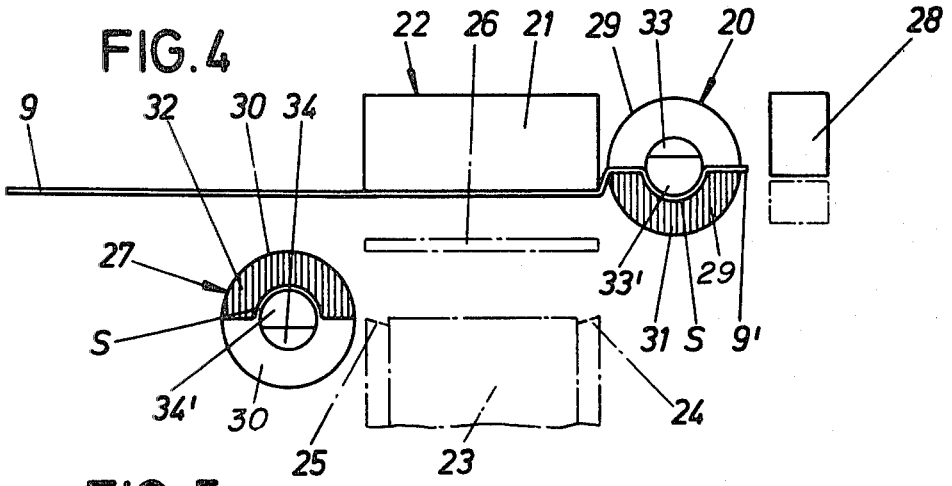
Figure 5:
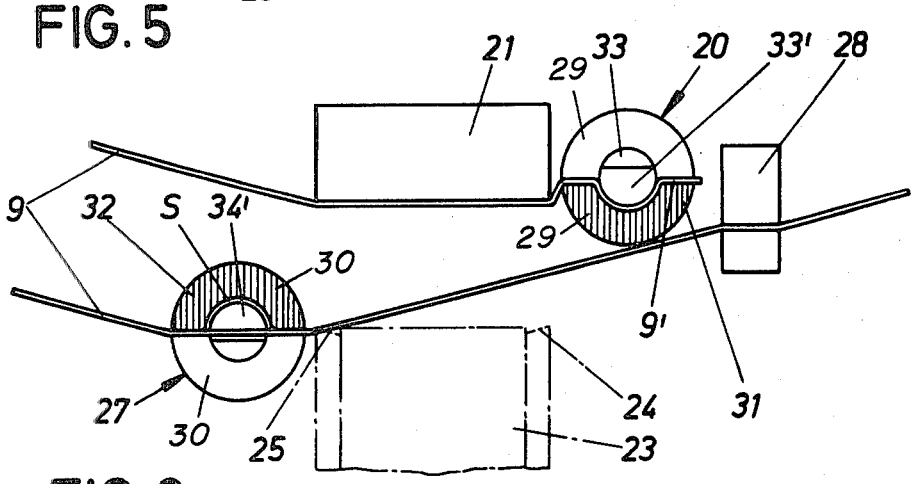
Figure 6:
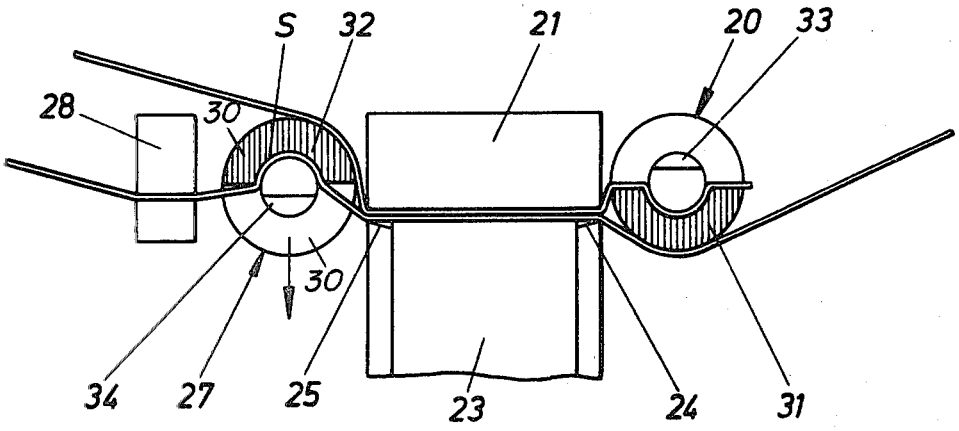
Figure 7:
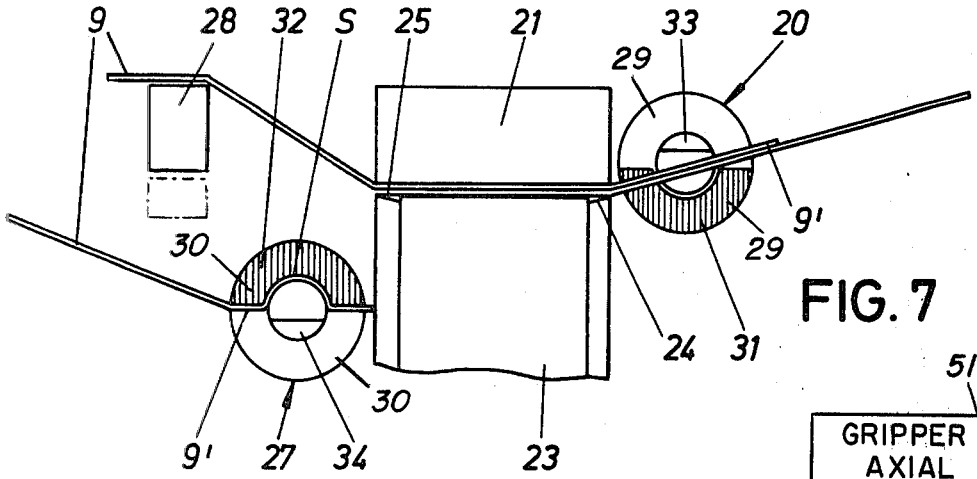
Figure 8:
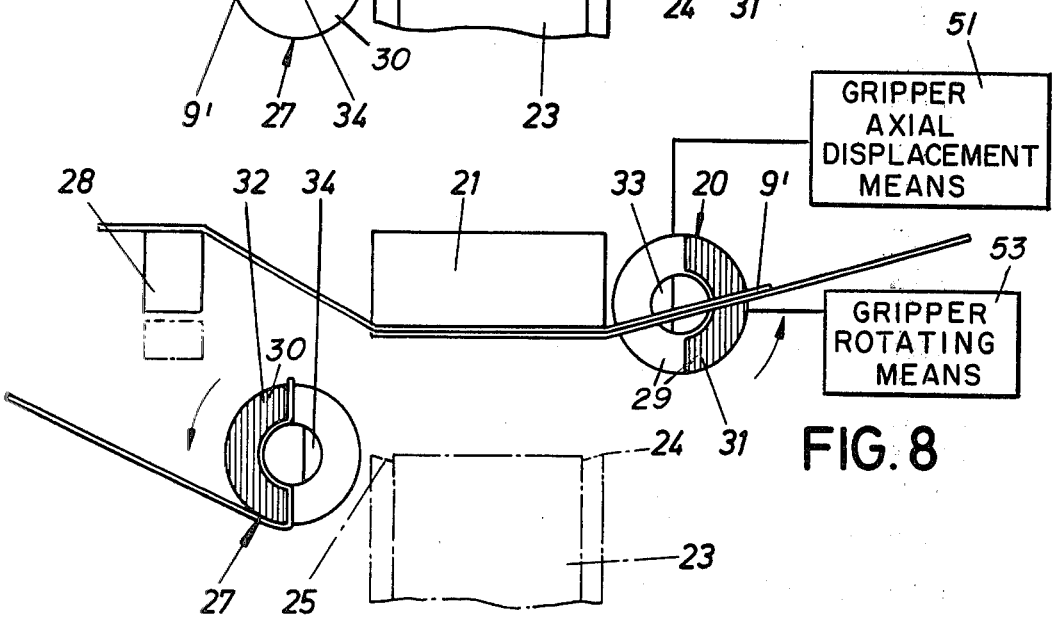
Figure 13:
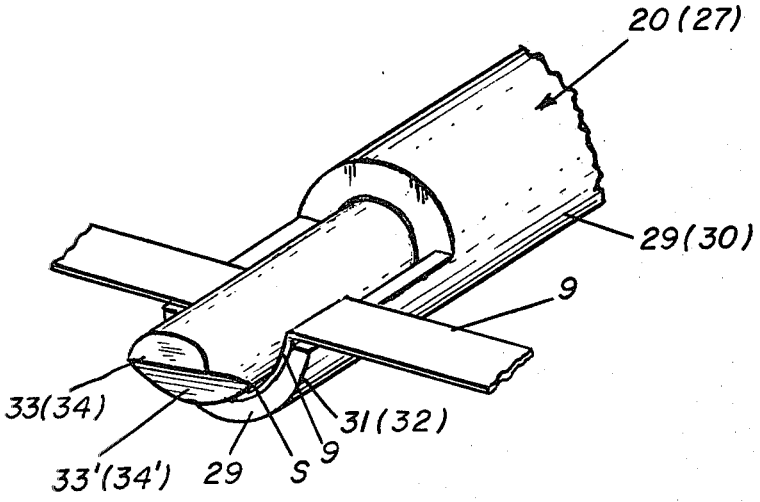
Figure 14:
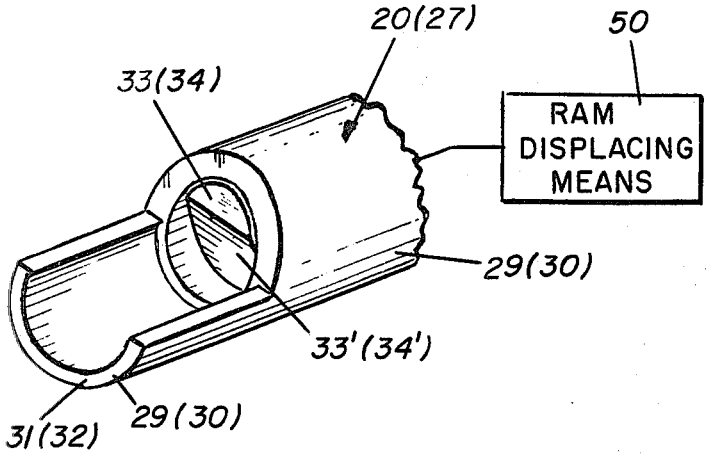

One preferred illustrative embodiment of the invention will be described with reference to FIGS. 1 to 12, wherein FIG. 1 is a side view of the machine in accordance with the invention by means of which the crosswise tying of packages can be effected, FIG. 2 is a top view of the machine, FIG. 3 is a view toward the ring which forms the tying means guide device in its starting position before the tying of a package, FIGS. 4–12 show diagrammatically intermediate positions in the forward and backward travel of the tying ring during the tying of a package, FIGS. 13 and 14 are broken away perspective views of the grippers shown in a position with the ram extended to clamp the tying means in the slot and with the ram retracted, respectively.

The machine shown in the drawing possesses the machine frame or pedestal 1. At the entrance end the tunnel 2 extends from the machine frame 1. The ring 3 which forms the tying means guide device is mounted within the tunnel. The drive discs 4 and 5 and a top guide disc 19 serve to support the ring.

Clutches (or couplings) and brake devices (not shown in the drawing) are associated or coordinated with the drive discs 4 and 5. One clutch (or coupling) rotates continuously counterclockwise, and the other clutch (or coupling) continuously rotates clockwise. However, at all times only one clutch is in engagement with the drive disc associated with it so that the ring 3 is either turned in the direction of the arrow x, or in the opposite direction of the arrow x'.

The entrance-side conveyor belts 6 serve to bring the package P into the position which is proper for tying. Conveyor belts 7 are arranged aligned flushly with the belt 6, a gap 8 being left between the conveyor belts 6 and 7. The plane of the tying means extends through this slot.

The tying means 9 is pulled off or withdrawn from the tying means drum 10. The latter is mounted on the shaft 11 of an extension 12 on the machine frame 1. Between the tying means drum 10 and the tying ring 3 there is interposed a tying means storage device 13 via which the tying means is fed to the tying means ring 3.

After a tying operation, the package P is conducted by the conveyor belts 7 to the tying ring 14, which is arranged transversely to the tying ring 3. Here the package obtains its crosswise tying. The drive of the tying ring 14 is designed similarly. The tying means 9 runs to this tying ring 14 from another tying means drum 15, and indeed in the same manner.

The tying ring 14 has associated with it conveyor belts 16, 17 and 18 which bring the package to the outlet side of the machine.

The conveyor belts form the support table for the package P which is to be tied. In FIG. 3 the package P extends in the plane of the tying means. The tying ring 3 is still disposed in the starting position. The end 9' of the tying means is held by the one gripper 20. The gripper 20 extends alongside of the pressing member 21 of the sealing device 22. The pressing jaw 23 which is moveable upwardly and downwardly is arranged opposite the pressing member 21 which is arranged in fixed position. Laterally of the pressing jaw 23 are the cutting knives 24 and 25 of the sealing device 22. A heating plate or blade 26 can move in between the pressing member 21 and the pressing jaw 23, the heating blade being indicated in dot-dash lines in FIG. 4.

The gripper 27 extends to the other side of the sealing device. Furthermore associated with the sealing device is the tightening or tensioning clamp 28 which can be moved from one side of the sealing device 22 to the other side.

Each of the grippers 20, 27 includes a mating or counter jaw 31, 32, respectively, which jaw is formed by a trough section constituting a sector of a sleeve 29 and 30, respectively, which sector projects integrally on one end of the gripper. That is each sleeve 29 (30) comprises a rear cylindrical portion and a front trough section integral therewith. A ram 33 and 34, respectively, is arranged axially displaceable in each sleeve 29, 30, respectively by a ram displacing means 50. Each ram 33, 34 has a beveled or inclined run-on surface 33' and 34', respectively. The rams 33, 34 define a gripper slot S in cooperation with the counter jaws 31, 32 associated with them respectively. (Compare FIGS. 13 and 14).

The grippers 20, 27 can carry out an axial longitudinal movement directed transversely to the tying plane by a gripper axial displacing means 51. They can furthermore be controlled in upward and downward directions by a gripper vertical shifting means 52. In addition, they can turn 180° by a gripper rotating means 53.

The following manner of operation results: In the starting position shown in FIGS. 3 and 4 the end 9' of the tying means is held by the gripper 20. The tying means 9 passes through the two tape rollers 36 and 37 of the tying ring 3. Additional tape rollers 38 are also provided on the tying ring 3. In the starting position, the tape rollers 36 and 37 range or extend in the position I. The pressing jaw 23 including the heating blade 26 lie outside the plane of tying. After the package P has come into the tying position, the tying ring 3 is turned 360° in the direction indicated by the arrow x. In this way the package is wrapped around and one layer of tying means is supported by the tape rollers 38 of the tying ring 3. During this operation the tying means leading to the tape rollers 36 and 37 is laid underneath against the counter jaw 32 of the gripper 27; see FIG. 5.

Figure 9:
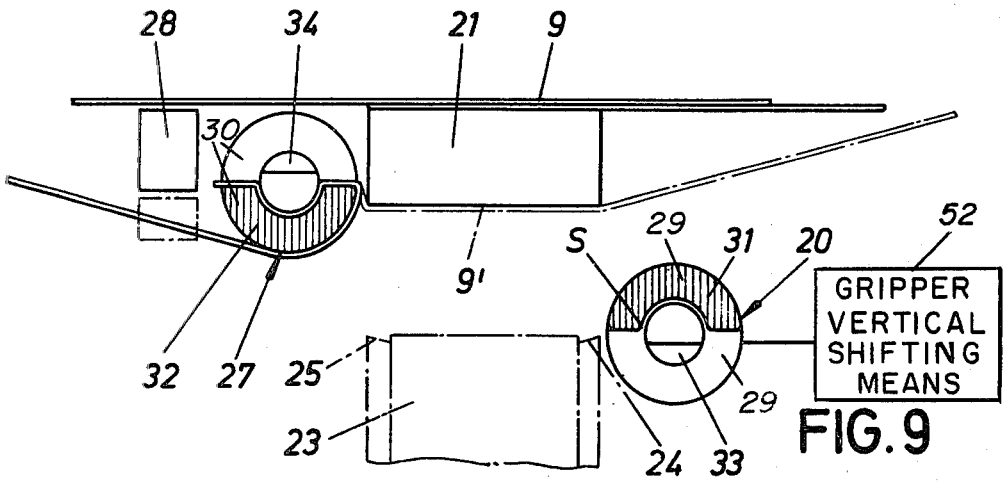
Figure 10:
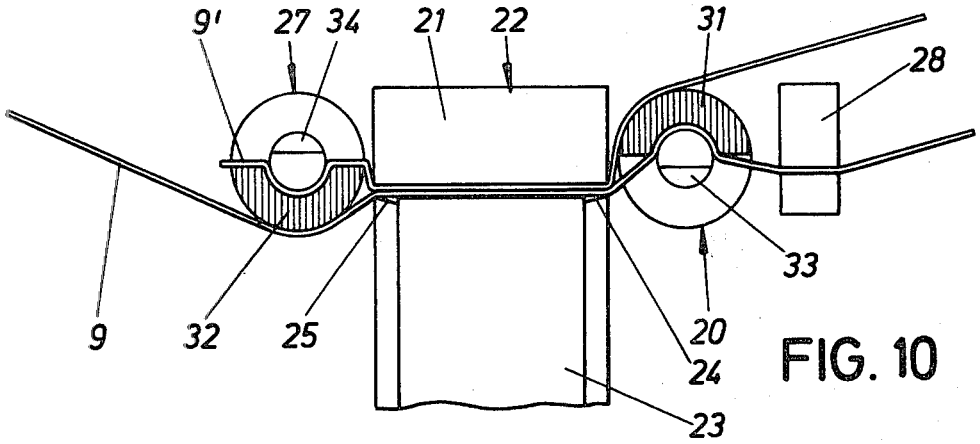
Figure 11:
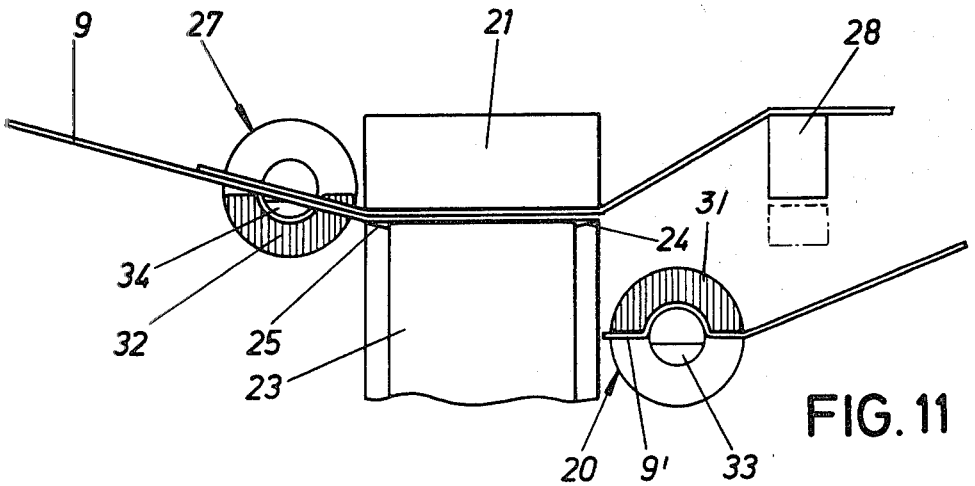
Figure 12:
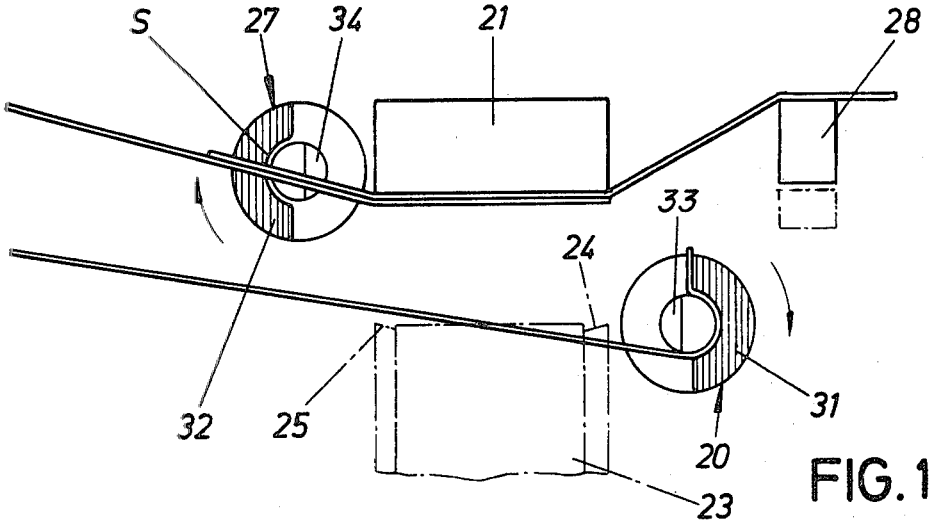

This application is possible since the ram 34 is still disposed in its retracted position. The band or tape clamp 28 now closes and moves to the other side of the sealing device 22. After this has taken place, the ram 34 moves forward and, by means of its run-on surface 34', the tying means 9 slides thereon and is wedgingly clamped in the slot S. The heating blade 26 moves forwardly, the tying means made of plastic or synthetic material is heated, the gripper 27 moves upwardly, the heating blade 26 moves back again, and the pressing jaw 23 steps into operation; see FIG. 6. After a certain cooling time the gripper 27 moves in the downward direction. In this way, the tying means 9 is pulled over the cutting knife 25 of the pressing jaw 23. This downward displacement is possible since the tightening clamp 28 has previously opened. The now existing end 9' of the tying means is held by the gripper 27. At the same time, the gripper 20, by the retraction or moving back of the ram 33, has released the tying means end 9' held by it. In addition, the gripper 20 itself has moved back and lies outside the plane of the tying means; see FIG. 7. Rotation of the grippers 20, 27 now takes place, and indeed in the direction indicated by the arrows; see FIG. 8. After reaching a rotation of 90°, the gripper 20 moves forward and in this position ejects the tying means 9 out of the sealing device and under the circumstances from time to time if necessary out of the tape clamp 28. After a further rotation of about 90° the position shown in FIG. 9 is reached. The tying means 9 which is wrapped around the package and extends above the pressing member 21 permits further conveyance of the package. Furthermore, simultaneously with the rotation of the grippers 20, 27, the gripper 27 has moved in the upward direction and the other gripper 20 in the downward direction. To be sure, the latter is still in a backward moved position. This position is the starting position for the next following tying operation, which is carried out in the direction of the arrow x'.

In the starting position for the oppositely directed tying operation, the tape rollers 36, 37 are also in position I. The tying ring now, however, moves back over a greater angle than 360°, namely greater by the angle alpha. The tape rollers 36, 37 then lie in position II which is represented by a dot-dash line in FIG. 3. The tying means end which has been previously placed in a loop form around the counter jaw 32 thereby comes into the proper alignment, shown in dot-dash lines in FIG. 9. After the beginning rotation, the gripper 20 has moved again into the ready position. The tape clamp 28 then travels to the other side of the sealing or closure device 22, the heating blade 26 enters into operation and the pressing jaw 23 moves in the upward direction, while the gripper 20 closes. After the binding or connection of the ends of the tying means, the gripper 20 moves in the downward direction after the tape clamp 28 has released or opened. In this way, the tying means is cut or separated by the cutting knife 24. The other gripper 27, on the other hand, has opened and has moved back; see FIG. 11. Upon the following rotation of the grippers in the direction indicated by the arrow, the gripper 27 moves forwardly and ejects the tying means out of the sealing device. The gripper 27 moves downwardly while the gripper 20 moves in the upward direction so that after completion of the rotation movement and corresponding displacement of the grippers in the vertical direction as well as a backward rotation of the tying ring 3 by the angle alpha into position I, the position shown in FIG. 4 is again present.

I claim:

1. In a machine for tying packages or the like with a tying means which is held fast at one end and guided by means of a tying means guide device around the package with the tying means guide device being driven cyclically back and forth, and upon a movement thereof, accumulating a layer of tying means which surrounds the package, and which is wound around the package, respectively, and grippers for holding the tying means fast, each of said grippers being formed with a gripper slot adapted to operatively cooperate with the tying means, each of said grippers constitutes gripper means for holding and releasing, respectively, said tying means in said slot moving means for moving said grippers together with an end of the tying means held fast by it in cyclic dependency in a rotary movement which turns the gripper slot around, the improvement comprising sealing means for sealing the end of said tying means, said sealing means has an end, said grippers constitute two grippers, said moving means includes displacing means for axially displacing the entire of said grippers each respectively at a time and rotating means for rotating said grippers each respectively at a time, said rotating means rotates one of said two grippers while said sealing means is on said tying means and after release of said tying means by said one gripper, each respectively at a time into a rotary position in which said gripper slot of said one gripper is substantially transverse to the length direction of the tying means and said axially displacing means displaces said one gripper to thereby abut the tying means so as to push the tying means beyond the end of and out of the sealing means.

2. The machine according to claim 1, wherein said grippers each comprise a first and a second gripper jaw, said first gripper jaw is formed as a ram which is axially displaceable in said second gripper jaw, said second gripper jaw is formed by a trough section of a ring sector which extends on an end side.

3. The machine according to claim 2, wherein said second gripper jaw constitutes a counter jaw coordinated to said ram with said slot formed therebetween.

4. The machine according to claim 2, further comprising a rotatably mounted sleeve, said sector is arranged on an end side of said rotatably mounted sleeve.

5. The machine according to claim 1, further comprising said sealing means is formed with a cutting blade, said grippers are additionally upwardly and downwardly moveable, said gripper means for alternately pulling the tying means held by them over the cutting blade of the sealing means.

6. The machine according to claim 2, wherein said ram has a beveled run-on surface adapted to cooperate with the end of the tying means.

7. The machine according to claim 5, wherein said sealing means includes a lower pressing jaw, said cutting blade is formed on an upper edge of said lower pressing jaw.

8. The machine according to claim 7, wherein said sealing means includes a stationary upper pressing member, said lower pressing jaw is moveable and cooperates with said pressing member, said sealing means further includes a heating plate moveable between said pressing member and said pressing jaw.

* * * * *

UNITED STATES PATENT AND TRADEMARK OFFICE

CERTIFICATE OF CORRECTION

PATENT NO. : 4,356,685
DATED : November 2, 1982
INVENTOR(S) : Hans Hugo Büttner

It is certified that error appears in the above-identified patent and that said Letters Patent are hereby corrected as shown below:

Column 5, (claim 1) Line 14 "slot" should read --slot,--

Signed and Sealed this

First Day of March 1983

[SEAL]

*Attest:*

GERALD J. MOSSINGHOFF

*Attesting Officer*

*Commissioner of Patents and Trademarks*